US010933302B2

(12) United States Patent
Costa

(10) Patent No.: US 10,933,302 B2
(45) Date of Patent: Mar. 2, 2021

(54) CHESS GAMES WITH CHANCE ELEMENTS

(71) Applicant: Play Chexi LLC, Las Vegas, NV (US)

(72) Inventor: Peter Costa, Las Vegas, NV (US)

(73) Assignee: Play Chexi LLC, Las Vegas, NV (US)

( * ) Notice: Subject to any disclaimer, the term of this patent is extended or adjusted under 35 U.S.C. 154(b) by 0 days.

(21) Appl. No.: 16/713,641

(22) Filed: Dec. 13, 2019

(65) Prior Publication Data

US 2020/0188769 A1 Jun. 18, 2020

Related U.S. Application Data

(60) Provisional application No. 62/779,467, filed on Dec. 13, 2018.

(51) Int. Cl.

| | |
|---|---|
| ***A63F 3/02*** | (2006.01) |
| ***A63F 3/00*** | (2006.01) |
| *A63F 1/04* | (2006.01) |

(52) U.S. Cl.

CPC ..... *A63F 3/00176* (2013.01); *A63F 3/00697* (2013.01); *A63F 3/02* (2013.01); *A63F 3/027* (2013.01); *A63F 2001/0475* (2013.01); *A63F 2003/025* (2013.01)

(58) Field of Classification Search

CPC ..... A63F 3/02; A63F 3/027; A63F 2003/025; A63F 2001/0475

USPC ..... 273/260, 261, 292, 302, 306, 307, 308

See application file for complete search history.

(56) References Cited

U.S. PATENT DOCUMENTS

| | | | | |
|---|---|---|---|---|
| 3,794,326 | A * | 2/1974 | Bialek | A63F 3/00895 273/260 |
| 4,998,736 | A | 3/1991 | Elrod | |
| 5,657,989 | A | 8/1997 | Acoba | |
| 5,887,873 | A | 3/1999 | Freeman | |
| 5,904,353 | A | 5/1999 | Aldridge | |
| 6,749,199 | B2 | 6/2004 | Boyd | |
| 6,886,830 | B1 | 5/2005 | Boyd | |
| 7,156,394 | B1 * | 1/2007 | Boyle | A63F 3/00697 273/255 |
| 7,448,630 | B1 | 11/2008 | Lam et al. | |
| 7,766,335 | B1 | 8/2010 | Greenawalt | |
| 8,382,113 | B2 | 2/2013 | Costa | |
| 8,398,083 | B2 | 3/2013 | Costa | |
| 8,657,289 | B2 * | 2/2014 | Bond | A63F 3/00643 273/255 |
| 8,708,792 | B2 | 4/2014 | Costa | |
| 8,905,404 | B2 | 12/2014 | Costa | |
| 8,960,676 | B2 | 2/2015 | Costa | |
| 2002/0043766 | A1 | 4/2002 | Berman | |
| 2002/0067000 | A1 | 6/2002 | Larson et al. | |
| 2003/0042677 | A1 | 3/2003 | Boyd | |
| 2006/0214373 | A1 | 9/2006 | Christian | |
| 2006/0232012 | A1 | 10/2006 | Boyer | |

(Continued)

FOREIGN PATENT DOCUMENTS

GB 1072945 A * 6/1967 ..... A63F 3/00697

*Primary Examiner* — Benjamin Layno

(74) *Attorney, Agent, or Firm* — Grumbles Law PLLC; Stephen F. Wolf; Brittany Nanzig

(57) ABSTRACT

The present disclosure describes a new game based upon the conventional game of chess. The new game includes a chessboard, chessmen, dice, and a custom set of the images of the six possible chessmen types taken in combinations of two, three, four, or five depending upon the game. This new game puts more challenge and variety into the game of chess.

5 Claims, 3 Drawing Sheets

(56) References Cited

U.S. PATENT DOCUMENTS

| | | | | |
|---|---|---|---|---|
| 2010/0127457 | A1 | 5/2010 | Gardiner et al. | |
| 2010/0285859 | A1 | 11/2010 | Costa | |
| 2011/0254223 | A1* | 10/2011 | Valentine | G07F 17/3279 273/243 |
| 2012/0135791 | A1 | 5/2012 | Chen et al. | |
| 2015/0011284 | A1 | 1/2015 | Costa | |
| 2016/0005273 | A1 | 1/2016 | Costa | |
| 2016/0023098 | A1* | 1/2016 | Dressendofer | A63F 3/0423 273/243 |
| 2016/0110959 | A1 | 4/2016 | Felsher et al. | |
| 2018/0012455 | A1 | 1/2018 | Costa | |

* cited by examiner

| | | |
|---|---|---|
| BBB | BQQ | NNP |
| BBK | BQR | NNQ |
| BBN | BRR | NNR |
| BBP | KKK | NPP |
| BBQ | KKN | NPQ |
| BBR | KKQ | NPR |
| BKK | KKP | NQQ |
| BKN | KKR | NQR |
| BKP | KNN | NRR |
| BKQ | KNP | PPP |
| BKR | KNQ | PPQ |
| BNN | KNR | PPR |
| BNP | KPP | PQQ |
| BNQ | KPQ | PQR |
| BNR | KPR | PRR |
| BPP | KQQ | QQQ |
| BPQ | KQR | QQR |
| BPR | KRR | QRR |
| | NNN | RRR |

B = Bishop
K = King
N = Knight
Q = Queen
P = Pawn
R = Rook

56 Possible 3 Piece Combinations for 3 Piece CHEXI Game

Figure 3

CHESS GAMES WITH CHANCE ELEMENTS

RELATED APPLICATIONS

The present disclosure claims the benefit of U.S. Provisional Patent Application Ser. No. 62/779,467, filed Dec. 13, 2018 and titled CHESS GAMES WITH CHANCE ELEMENTS which is herein incorporated by reference in its entirety.

FIELD

The present disclosure relates to a new game that includes new game pieces

BACKGROUND

The Chess industry needs innovation. It needs a model that can be monetized in order for the industry to sustain growth. Standard chess is the ultimate in strategy, yet it's that same fundamental quality which prohibits chess from mass appeal to player participation into chess tournaments. Unlike poker, the outcome to chess tournaments is restricted dramatically to the highest ranking players taking part. As such, and unlike poker, the chess industry cannot enjoy the same rewards or exposure, despite an estimated 600+ million adult players chess players globally. Chess has its masters, but it needs its masses.

SUMMARY

A chess game is disclosed that includes rules and game components for a new game that has more elements of chance incorporated into it. The current disclosure focuses on the custom cards that are made for the game, the rules of which are also disclosed herein.

In one aspect, a custom card for a game is disclosed that includes two, three, four, or five random images of the six different possible chessmen from a chess game on a card, wherein each card has a different combination of the six different possible chessmen depicted. Each card can include two images of all of the possible combinations the six different possible chessmen on a chess set. In another embodiment, each card can include three images of all of the possible combinations the six different possible chessmen on a chess set. In yet another embodiment, a custom card for a game can include four images of all of the possible combinations the six different possible chessmen on a chess set. In yet another embodiment a custom card for a game can include five images of all of the possible combinations the six different possible chessmen on a chess set. The current disclosure also includes a kit for playing a game that includes a chessboard a pair of dice; and a set of custom cards as described above.

Features and advantages of the present disclosure will be more readily understood from the following detailed description which should be read in conjunction with the accompanying drawings.

BRIEF DESCRIPTION OF THE DRAWINGS

The drawings are schematic illustrations and are not intended to limit the scope of the invention in any way. The drawings are not necessarily to scale.

FIG. 3 is a listing of all possible combinations for a three-piece playing card according to an embodiment of the present disclosure.

DETAILED DESCRIPTION

Figure 1:
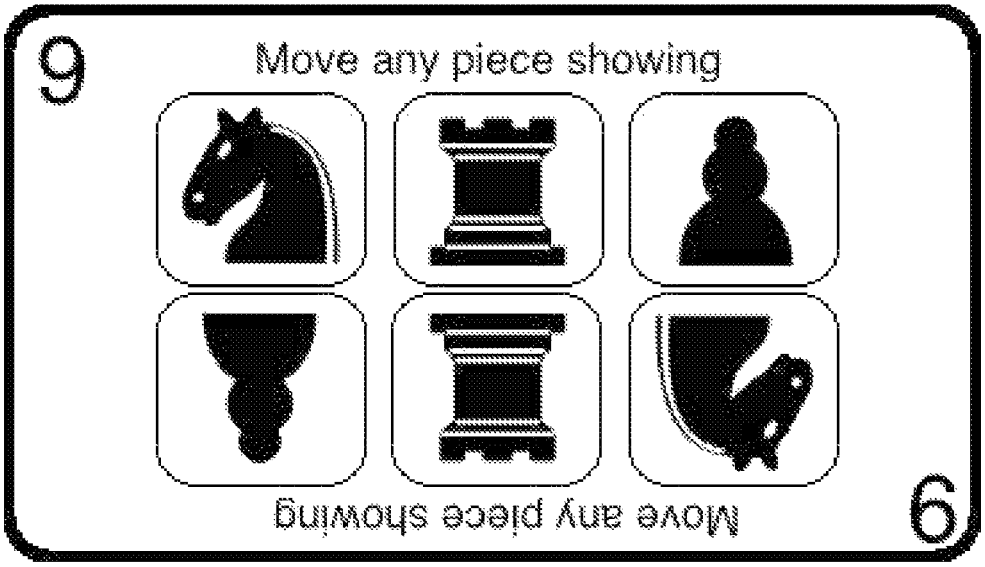
FIG. 1 is a schematic illustration for a three-piece playing card according an embodiment of the present disclosure.

In the following description, reference is made to the accompanying set of drawings that form a part of the description hereof and in which are shown by way of illustration several specific embodiments. It is to be understood that other embodiments are contemplated and may be made without departing from the scope or spirit of the present disclosure. The following detailed description, therefore, is not to be taken in a limiting sense.

While the format of the game herein named, "Chexi", of the present disclosure is not only the way for the chess industry to sustain growth, it is a unique opportunity for the industry to take chess tournaments to the masses. The format of the game is simple and requires just basic knowledge in order to play. The main aspect of the gameplay is the introduction of the element of chance. This in itself is not only crucial to ensuring that anyone can beat anyone, it does so in a format with the flexibility to increase or decrease strategy or chance at will.

A sliding scale between strategy and chance is fundamental to attracting every chess player of every skill level. This can be achieved by how the disclosed cards are utilized and which of the rules are applied. Mix and match of versions of the disclosed game can be contemplated that may have the added option of a "Twist" feature which allows a player's turn to be played with the element of chance or purely by optimum move. Moreover, "Twist", can also allow for the ratio of alternate turns to increase from a ratio of one for one, to two for one, three for one or even higher.

As an example, a ratio of one to one will certainly allow for chess strategy to be more calculated. A ratio of two to one in favor of optimum play, would further increase strategic calculations. A ratio of three to or even four to one in favor of optimum play and strategic calculations become an even greater aspect of the game. Reverse the ratio to favor the element of chance, and the opposite would apply.

This flexibility to mix and match can introduce even more powerful advantages and additions to how tournaments are structured. The flexibility to allow for any of the versions to be utilized for a single tournament is clear, as is fact that players can form preferences. In order to cater to every preference, a series of a dozen tournaments may implement a dozen different versions. There is, however, also the option to allow players the switch between versions on agreement.

As an example, one version of the disclosed game may act as default to a specific tournament, but only if players can agree on any other version. The flexibility provided by the "Twist" and "Mix and Match" additions not only provide options, it does so with the ability to cater to chess players from novices to masters.

New game elements disclosed herein include the introduction of "Twist" i.e, alternate moves between moves governed by rolls of the dice and optimum play which allows players to choose a move as in standard chess. This is hugely important in allowing for different versions of Chexi to be created and depending on the ratio of "twist", offer a sliding scale between the element of chance and element of skill. This ratio is also flexible and can increase or decrease depending on player preference. A higher ratio of optimum moves compared to moves governed by the dice increases the skill element and vice versa.

Bonus rolls are now also optional as this allows for more versions to be created and also allow for dice to utilized and in different ways. Moreover, they can allow the game play to be played with a set number of dice between two, three, four, five, six or more dice and for these to determine number of future moves. As an example, rolling five dice, will determine the next five possible moves allowed by players. These could also be played with all the dice or selected number of dice to be visible or not visible (secret) to the opponent.

The "Twist" feature can also be fundamental in adding to that sliding scale between the elements of skill and elements of chance. Furthermore, this also dramatically increases the number of versions that can be created by a "mix and match" feature detailed in the application. A s explained in those details, this introduces another very powerful addition and unique format in which players may play one, two or more versions within one game or a series of games and tournaments.

With chess industry eager to embrace innovation and chess variants, the Chexi Cards and the features the cards not only introduce over three dozen versions, players will be able to create more versions.

Rules Overview

Chexi Rules for Dice and Card Versions

1. All moves must be legal chess moves and all chess rules apply unless otherwise stated.

2. Castling maybe allowed in some versions and not allowed in other versions. The en-passant rule may apply in some versions and not apply in other versions.

3. All moves are governed by the roll of Chexi dice or drawing or holding Chexi cards drawn or as otherwise stated, such as bonus roll or more than one roll to escape check. Both depict the chessmen allowed to move for that turn. Although four chessmen may be depicted on each card, these could be bracketed for versions requiring just two or three chessmen, as well as all four.

4. Players may move any chessman depicted, on occasions may be unable to move or chose not to move any piece depicted if not beneficial to do so.

5. When placed in Check, a player will have a certain number of turns ranging from one or two, three, four or more, to directly escape from check, otherwise the player is "Diced Out" and the game is lost. The number of turns to escape check will vary between versions, but three turns may be chosen as default.

"Twist" Addition

The "Twist" optional addition to Chexi refers to any version in which play can alternate between optimum moves versus moves governed by a cards or dice. This ratio between the two can increase or decrease. A higher ratio of optimum moves versus moves governed by card or dice, will tend to increase skill and strategy requirements. A lower ratio of optimum moves would tend to increase the element of chance.

Rules (A 1), "Bonus Plays" can be applicable in any of the versions by way of specific chessmen being depicted either on dice or cards, but can also not apply in certain versions. When gaining a "bonus play" players would play again in accordance with the rules of the version in play. There is no limit to the number of consecutive bonus plays earned. When placing an opponent in check by way of a bonus play, check may be removed with subsequent bonus plays.

(A 2) Dice or cards depicting a Trio (three of a kind), the player may move any piece and play another turn.

(A 3) A player escaping from check with a bonus play will play another turn.

(A 4) A player may remove an opponent from Check at any stage during any bonus plays.

Winning the Game

Check Mate

Diced Out

Attrition, leaving the opponent with just the King and Pawns remaining.

Opponent resigning

Point Score for any points version

Chexi Card Versions

Each deck of Chexi Cards contains at least fifty-six Chexi Cards, which equates to each unique random outcome generated by rolling three dice, with each dice depicting a of the six chess pieces on each of the six sides of the dice. Although this number may vary if further dice outcomes are introduced into the game. To ensure against potential card counting and to offer equal mathematical probabilities, each player would draw cards from two decks allocated to each player, or two or more decks shared by both players.

By using Chexi cards, a variety of versions of Chexi can be played. By using the rules stated, two or more dozen variations can apply, with each offering different levels of skill and chance. By increasing the number of cards held by players, the element of chance is reduced and strategy is increased. This introduces a sliding scale that can be expanded by also introducing the "Twist" addition to any version.

Possible versions include, but are not limited to:

Two Chessmen depicted—offering two possible moves.

Three Chessmen depicted—offering up to three possible moves

Four Chessmen depicted—offering up to four possible moves

Bonus Plays are gained by the dice or cards depicting a specific chessman or specific chessmen such as cards or dice depicting a pair or a Trio.

A bonus play could only be gained under the rule that the specified chessman, pair is able to move. Moving any other chessman completes a turn.

A tournament format could offer a specific version as default, but players may be given the option to agree on any of the possible versions. This will allow for all chess players to at least be in a position to play the version of preference.

The default version may also vary and may or may not include the "Twist" addition. A Mix and Match of the above versions ensures the flexibility to add versions on demand. As an example, six versions could be offered with one default version. If players fail to agree on any of the other five versions offered, default version will used. There is also the option to allow players to play a number of versions within one tournament.

One Card Version and With Optional Twist.

A standard chess board and pieces are used to play chess in which moves are governed by the chessmen depicted on the card. Bonus rolls can apply depending on the version utilized. In the following versions, each chessman will described as A, B, C, and D. In normal Chexi there are six different types of chessmen. When referring to a two chessmen version, the two chessmen will be designated A and B.

When referring to three chessmen, the three chessmen will be referred to as A, B, and C. For the four chessmen version, A, B, C, and D all four will apply.

Two Chessmen Version—One Card Version

Players may move chessman A or 13 shown on the card, be unable to move or decline to move if not beneficial. If both chessmen form a pair, player may move any chessman and play again. If A or B depicts a pawn, a player gains a bonus roll if able to move a pawn. A player placed in Check, may draw have any number of cards to escape chess chosen by the players prior to the start of a game. it is suggest three or four draws would be ideal. A player failing to escape check from the allotted cards is "Dice out" and the game is lost. There is no set limit to the number of repeat bonus plays a player earns. This also applies if the player has placed the opponent in check and may even remove opponent from check during a bonus play.

Two Chessmen Version—One Card with Twist.

A "Twist" addition to the game refers to any version in which play alternates between optimum moves versus moves governed by a card. This ratio between optimum move and card move can be increased or decreased depending on preference.

Three Chessmen Version—One Card and One Card Twist

Players may move chessman A, B, C shown on the card, be unable to move or decline to move if not beneficial. Any pair earns a bonus play if the pair depicted is moved. Moving the unpaired piece would complete the turn and no bonus is won. For all three depicting the same piece, player may move any piece and okay again. A player in check has a maximum of three cards to escape directly from check otherwise the player is "Diced Out" and the game is lost. There is no set limit to the number of repeat bonus plays a player can earn. This also if the player has placed the opponent in check and may even remove opponent from check during a bonus play.

Three Chessmen Version—Two Cards and With Twist.

Players may move chessman A, B, C shown on any of the two card, be unable to move or decline to move if not beneficial. Any pair earns a bonus play if the pair piece depicted is moved. Moving the unpaired piece would complete the turn and no bonus play is won. If all three depict the same piece, player may move any piece and okay again. A player in check has a maximum of three cards to escape directly from check otherwise the player is "Diced Out" and the game is lost. There is no set limit to the number of repeat bonus plays a player can earn. This also if the player has placed the opponent in check and may even remove opponent from check during a bonus play.

Three Chessmen Version—Three Cards and With Twist.

Players may move chessman A, B, C shown on any of the three cards, be unable to move or decline to move if not beneficial. Any pair earns a bonus play if the pair piece depicted is moved. Moving the unpaired piece would complete the turn and no bonus play is won. If all three depict the same piece, player may move any piece and okay again. A player in check has a maximum of three cards to escape directly from check otherwise the player is "Diced Out" and the game is lost. There is no set limit to the number of repeat bonus plays a player can earn. This also if the player has placed the opponent in check and may even remove opponent from check during a bonus play.

Four Chessmen Version—One Card and With Twist.

Players may move any of the four chessmen depicted on the card, be unable to move or decline to move if not beneficial. Any pair earns a bonus play if the pair piece depicted is moved. Two doubles would allow either one or both pair pieces to be moved to gain a bonus play. If three of the four depict the same piece, player may move any piece and play again. Any four of a kind wins the games. A player in check has a maximum of two cards to escape directly from check otherwise the player is "Diced Out" and the game is lost. There is no set limit to the number of repeat bonus plays a player can earn. This also if the player has placed the opponent in check and may even remove opponent from check during a bonus play.

Four Chessmen Version—Two Cards and With Twist.

Players may move any of the four chessmen depicted on the two cards, be unable to move or decline to move if not beneficial. Any pair earns a bonus play if the pair piece depicted on either of the cards is moved. Two doubles on one card would allow either one or both pair pieces to be moved to gain a bonus play. If three of the four depict the same piece, player may move any piece and play again. Any four of a kind wins the games. A player in check has a maximum of two cards to escape directly from check otherwise the player is "Diced Out" and the game is lost. There is no set limit to the number of repeat bonus plays a player can earn. This also if the player has placed the opponent in check and may even remove opponent from check during a bonus play. Checkmate, "Diced Out"—failing to escape check from allotted cards. Attrition—leaving opponent with just the King and pawns remaining. Points Core—scoring most form a predetermined number of rolls.

The disclosed "Chexi" game uses a chess board and chessmen can be played by applying chess rules unless otherwise stated. The difference between Chexi and standard chess, is the element of chance introduced by the custom deck. The custom deck can include fifty-six cards for the three-piece game. but may vary depending on versions used. On each card, one of only fifty-six possible combinations of the six different chess pieces taken three at a time is depicted in FIG. 1. FIG. 1 is a schematic illustration for a three-piece playing card according an embodiment of the present disclosure. In another card embodiment, a combination of chess pieces taken four at a time is illustrated in the schematic illustration shown in FIG. 2. FIG. 3 is a listing of all possible combinations for a three-piece playing card with the six possible chess pieces taken randomly three at a time according to an embodiment of the present disclosure. In the embodiments of custom cards for the three-piece game illustrated in FIG. 1 and the four-piece game illustrated in FIG. 2, the cards are visible from each direction and have repeated sequences of the same combination although this is not required for the custom cards of the present disclosure.

The cards introduce can a form of a sliding scale between strategy and chance. The scale begins by having more optimum moves versus a move governed by the card. The higher the ratio of optimum moves versus card moves, the higher the skill and strategy required. The lower the ratio of optimum moves versus cards, the higher the element of chance. The same applies to the number of cards in play. The more cards in play for a player, the higher the skill and strategy requirements. The few cards, the higher the element of chance.

Figure 2:
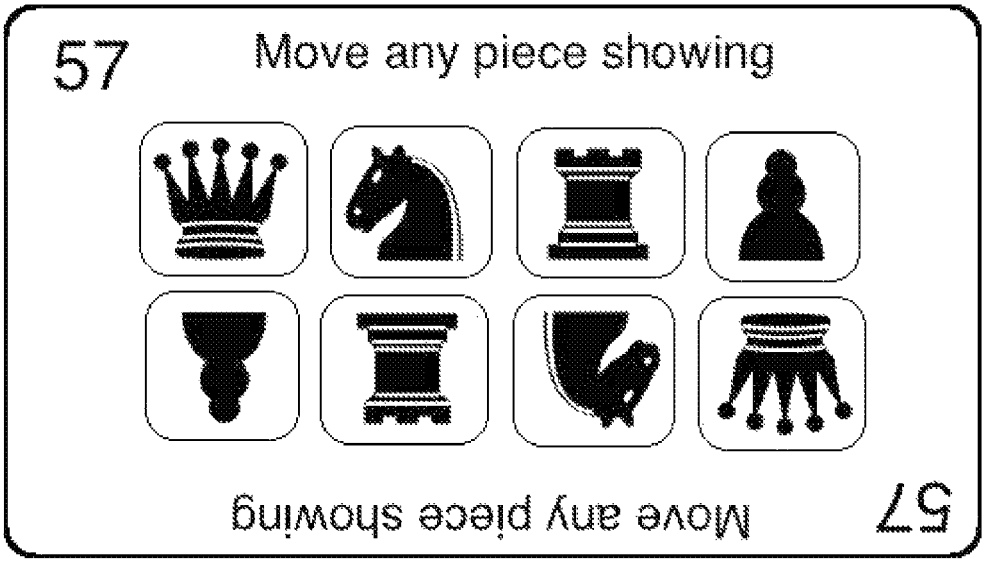
FIG. 2 is a schematic illustration of a four-piece playing card according to an embodiment of the present disclosure.
Figure 4:
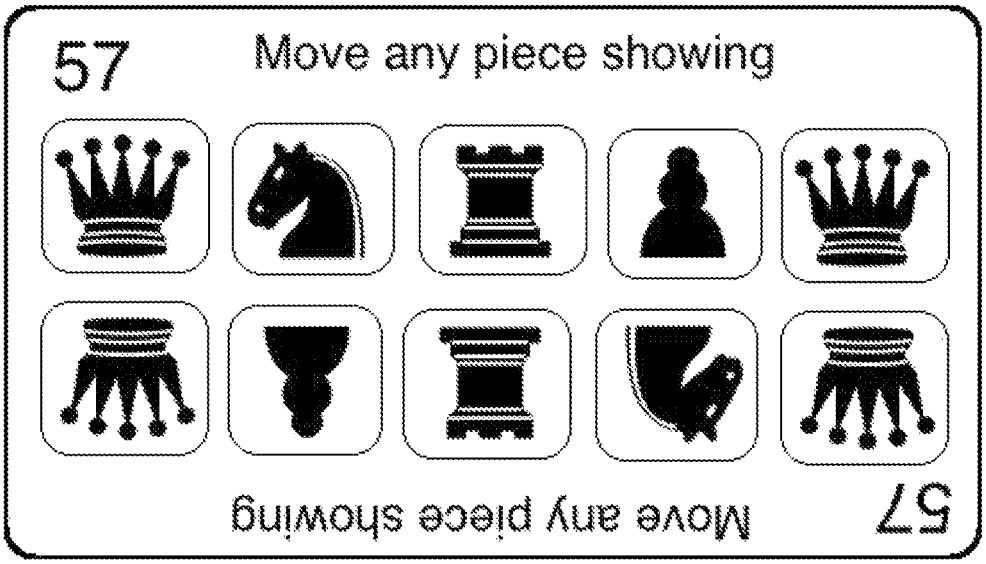
FIG. 4 is a is a schematic illustration for a five-piece playing card according an embodiment of the present disclosure.
Figure 5:
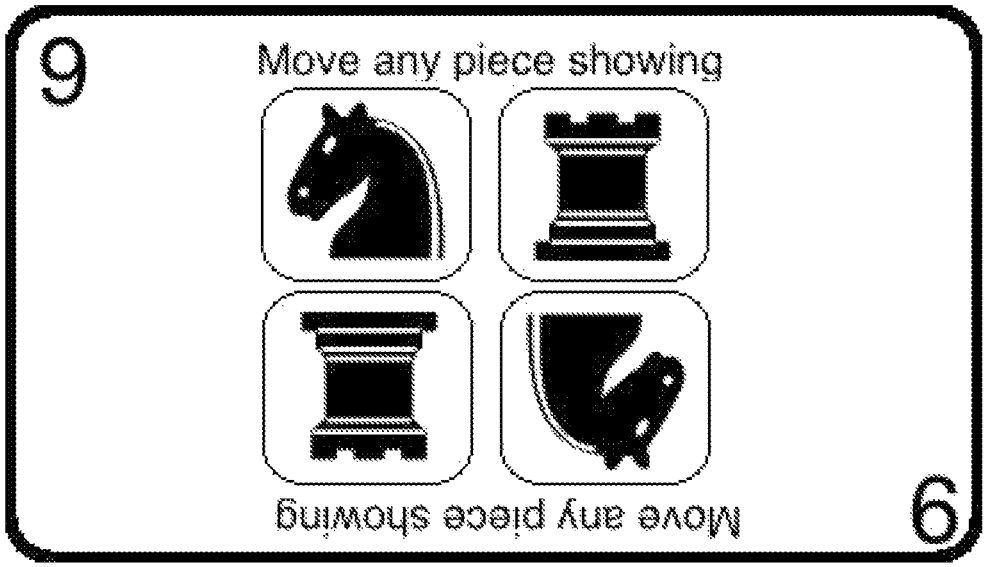
FIG. 5 is a schematic illustration of the front and back of a single six-sided die showing that each face contains a single depiction one of the possible six different chessmen.

In the game of Chexi, as in chess, there are six different types of chessmen. They include the King, Queen, Bishop, Knight, Rook, and Pawn. FIG. 1 illustrates one card of the 56 possible three-piece combinations of six chessmen. In this illustration, for example, the illustrated combination includes a knight (horse-shaped icon), a rook, and a pawn as are standard in chess depictions. FIG. 2 shows one card of the possible four-piece combinations of the six different types of chessmen. The card illustrated in FIG. 2 includes a queen, a knight, a rook, and a pawn. As shown in FIG. 3, there are 56 combinations of three-piece cards where each card has a different combination of three of the six types of chess men. Cards can be created that depict four or more chessmen, randomly drawn from a set criterion allowing all four or more chessmen to draw all four or more draws. As an example, with four chessmen depicted on a card, all four could be the same. In this example, four chessmen will be depicted as shown in FIG. 2. Depending on the version in play, any combination can be selected. For example, two of the four chessmen can be utilized to play one more variation. Likewise, with utilizing all the four chessmen can create further variations. Also, one card can utilize two of the four as one possible move and the two other chessmen form another possible move. The game can also be played open face, meaning the cards are visible to the opponent, or closed faced and hidden from the opponent.

A deck of cards is a set of all of the cards that depict all of the three-piece combinations of the six possible chess pieces for the three-piece game (56 in total), all of the four-piece combinations of the six possible chess pieces, or all of the five-piece combinations of the six possible chess pieces.

Points Version

The object is to accumulate points during a predetermined number of turns or moves.

1. Players select the number of turns for example, 10, 15 or 20.

2. Bonus rolls do not count as turns but as part of one turn.

3. Players can begin a game with all pieces in their starting place or with one or more advanced pawns. As an example, advanced two paws would ensure all chess pieces could move at the start of a game.

Points Scoring

Each piece is allocated a points value when captured and points are earned for roll of the dice an opponent fails to escape from check. Example points values.

Queen: 30 points.

Rooks, Bishops and Knights: 20 points.

Pawns 7 points

Opponent failing to escape from check: 5 points for each roll of the dice.

A bonus of ten points would be awarded to a player capturing both an opponent's Rooks, Knights or Bishops.

Rules:

Played as standard to the Chexi rules with the exception of the check rule. In this version, a player in check continues to roll until escape from check has been achieved.

Irrespective of the number of rolls it takes to escape check, escaping from check is counted as one turn or move.

While embodiments of the invention have been illustrated and described, it will also be apparent that various modifications can be made without departing from the scope of the invention. it is also contemplated that various combinations or sub combinations of the specific features and aspects of the disclosed embodiments can be combined with or substituted for one another in order to form varying modes of the invention. accordingly, it is not intended that the invention be limited, except as by the appended claims. all references cited within are herein incorporated by reference in their entirety.

What is claimed is:

1. A deck of custom cards comprising:

a plurality of cards, each card having disposed thereon a set number of images, the set of images consisting of depictions of a standard group of six chessmen, wherein the standard group of six chessmen are selected from a king, a queen, a bishop, a knight, a rook, and a pawn, and wherein the set of images on all of the plurality of cards in the deck comprises all the possible combinations of the standard group of six chessmen.

2. A deck of custom cards according to claim 1, consisting of a twenty-one-card deck, wherein each card of the twenty-one-card deck consists of a set of two images disposed thereon, and wherein the set of two images consists of all twenty-one possible two-depiction combinations of the standard group of six chessmen.

3. A deck of custom cards according to claim 1, consisting of a fifty-six-card deck, wherein each card of the fifty-six-card deck consists of a set of three images disposed thereon, and wherein the set of three images consists of all fifty-six possible three-depiction combinations of the standard group of six chessmen.

4. A deck of custom cards according to claim 1, consisting of a one-hundred-twenty-six-card deck, wherein each card of the one-hundred-twenty-six-card deck consists of a set of four images disposed thereon, and wherein the set of four images consists of all one-hundred-twenty-six possible four-depiction combinations of the standard group of six chessmen.

5. A deck of custom cards according to claim 1, consisting of a two-hundred-fifty-two-card deck, wherein each card of the two-hundred-fifty-two-card deck consists of a set of five images disposed thereon, and wherein the set of five images consists of all two-hundred-fifty-two possible five-depiction combinations of the standard group of six chessmen.

* * * * *